US006598431B2

(12) United States Patent
Teran et al.

(10) Patent No.: US 6,598,431 B2
(45) Date of Patent: Jul. 29, 2003

(54) OZONE CLEANING OPERATION

(75) Inventors: Alfredo J. Teran, Cape Canaveral, FL (US); Richard G. Wood, Merritt Island, FL (US); Nidal A. Samad, Merritt Island, FL (US); Carlos V. Diaz, Merrit Island, FL (US); Louis V. Mangiacapra, Mims, FL (US)

(73) Assignee: Agrimond, LLC, Cape Canaveral, FL (US)

( * ) Notice: Subject to any disclaimer, the term of this patent is extended or adjusted under 35 U.S.C. 154(b) by 0 days.

(21) Appl. No.: 09/681,800

(22) Filed: Jun. 7, 2001

(65) Prior Publication Data

US 2002/0032931 A1 Mar. 21, 2002

Related U.S. Application Data

(60) Provisional application No. 60/233,768, filed on Sep. 19, 2000.

(51) Int. Cl.[7] ..... D06F 39/08
(52) U.S. Cl. ..... 68/17 R; 68/207
(58) Field of Search ..... 68/207, 17 R, 68/902, 12.02, 12.18

(56) References Cited

U.S. PATENT DOCUMENTS 3,899,685 A * 8/1975 Francis et al.
5,069,880 A * 12/1991 Karlson
5,082,558 A * 1/1992 Burris
5,097,556 A * 3/1992 Engel et al.
5,207,993 A * 5/1993 Burris
5,213,773 A * 5/1993 Burris
5,245,845 A * 9/1993 Langford
5,313,811 A * 5/1994 Wasinger et al.
5,598,316 A * 1/1997 Kasting, Jr.
5,674,410 A * 10/1997 Nakajima et al.
5,806,120 A * 9/1998 McEachern
5,939,030 A * 8/1999 Moxley et al.
5,940,988 A * 8/1999 Eisen
5,960,501 A * 10/1999 Budick
5,960,649 A * 10/1999 Burdick
6,085,556 A * 7/2000 Moon
6,254,838 B1 * 7/2001 Goede

* cited by examiner

*Primary Examiner*—Frankie L. Stinson
(74) *Attorney, Agent, or Firm*—Anton J. Hopen; Smith & Hopen, P.A.

(57) ABSTRACT

An apparatus and method for using a dry cleaning machine to clean laundry that reduces environmental impacts by the substitution of ozone for the hazardous solvents traditionally used in the dry cleaning washing process. The apparatus and method for dry cleaning includes the steps of filtering the water whereby any debris present in the water is removed, measuring the dissolved ozone concentration of the water, recirculating the water between the tank and the water purifier until a desired ozone concentration is realized ensuring that the desired dissolved ozone concentration of the water is attained prior to the start of the cleaning process and continuously recirculating the water through the dry cleaning washing machine, the water purifier, and the tank during the cleaning process.

2 Claims, 3 Drawing Sheets

OZONE CLEANING OPERATION

CROSS-REFERENCED TO RELATED APPLICATIONS

This application claims the benefit of U.S. Provisional Application No. 60/233,768 filed Sep. 19, 2000. The disclosure of the provisional application is incorporated herein by reference.

BACKGROUND OF THE INVENTION

1. Field of Invention

This invention relates to an apparatus and method for cleaning wish ozone, and more particularly, to a system for treatment with ozone so that hazardous solvents that are currently used in the cleaning process are reduced or eliminated.

2. Background of the Invention

A dry cleaning process for laundry is similar to the wet cleaning process for laundry except that in contrast to the wet cleaning process, the dry cleaning process uses solvents instead of water. Typically, as the laundry is agitated in a dry cleaning machine, there is a constant flow of clean solvent from a pump and filter system. The dirty solvent is continuously being removed from the machine and recirculated through a filter and back to the dry cleaning machine during the agitation cycle.

After completion of the agitation cycle, the laundry will go though a drying cycle to remove the solvent from the laundry. A spin cycle is used to first remove a substantial amount of the solvent from the laundry through centrifugal force that is generated by rapidly rotating the laundry. The laundry is then exposed to circulating dry air to remove any remaining trace amounts of solvent. The remaining fumes of solvent are collected and condensed over cooling coils. Any water moisture that may have been introduced into the dry cleaning process is also removed from the solvent prior to reuse of the solvent.

Perchloroethylene (PERC or PCE), a potential human carcinogen, is the most commonly used dry cleaning solvent. Air releases of PERC and petroleum solvents used to clean fabrics are the primary environmental release from dry cleaning. Groundwater contamination by the solvents can also occur through spills and inadequate storage and drain disposal. Improper disposal of solvent laden material, such as filters, can also contribute to environmental contamination.

Exposure to the solvents commonly used in dry cleaning shops can occur through skin absorption, eye contact, or inhalation of the vapors. Symptoms associated with exposure include depression of the central nervous system, damage to the liver and kidneys, impaired memory, confusion, dizziness, headache, drowsiness, and eye, nose, and throat irritation.

It has been estimated that there are approximately 34,000 commercial dry cleaners that process a total of approximately 825,000 tons of clothes per year (USEPA 1991b). Accordingly, what is needed in the art is to reduce or eliminate the use of hazardous solvents that are used during the dry cleaning process for laundry.

The application of ozone in the wet cleaning process for laundry has been recognized and used extensively. The typical wet cleaning process for laundry uses water, bleaching agents and detergents. Ozone can be substituted in the wet cleaning process for the detergents and bleaching agents. Ozone is a powerful oxidant that can be used as the primary disinfecting, cleaning and bleaching agent in the wet cleaning process for laundry.

Similarly, continuing efforts are being made to improve dry cleaning apparatus and methods through the use of ozone. By way of example, note U.S. Pat. Nos. 5,511,264 and 5,488,842 to Nishioka et al. U.S. Pat. No. 5,511,264 discloses a method for deodorizing and refreshing dry cleaning petroleum group solvents using ozone and U.S. Pat. No. 5,488,842 discloses an apparatus using such a method, which can maintain the circulating solvents in a fresh condition for a long time. The apparatus and method of Nishioka et al. does not teach a mechanism by which dry cleaning solvents are reduced or eliminated.

U.S. Pat. No. 5,996,155 to Chao et al. discloses a dry cleaning process that uses liquid carbon dioxide and not hazardous solvents. However, Chao et al. teaches that carbon dioxide will only exhibit liquid-like properties under pressure and although hazardous solvents are eliminated, the costs to retrofit existing dry cleaning equipment would be high in comparison to using water with dissolved ozone.

U.S. Pat. Nos. 5,960,501 and 5,960,649 to Burdick, U.S. Pat. No. 6,006,387 to Cooper et al., and U.S. Pat. No. 5,625,915 to Radler et al. disclose a wet cleaning system and method for treating laundry with ozone. The aforementioned teachings do not provide a mechanism by which there is enough dissolved ozone available to meet the demand of the soiled laundry and maintain a desired dissolved ozone concentration. Specifically, previous systems typically furnish low levels of ozone because ozone is injected in the return line of the washer.

Another grouping of background patents are those patents that disclose the addition of ozone to the water prior to use in a wet cleaning washing machine. By way of example, see U.S. Pat. Nos. 5,097,556 and 5,181,399 to Engel et al., U.S. Pat. No. 5,656,246 to Patapoff et al. and U.S. Pat. No. 5,493,743 to Schneider et al. that teach closed loop ozonated wash water systems. Similarly, U.S. Pat. No. 5,409,616 to Garbutt et al. teaches a method and apparatus that recycles used wash water by way of a closed loop system using ozone as a cleaning agent.

U.S. Pat. No. 3,065,620 to Houser and U.S. Pat. No. 5,313,811 to Wasinger et al., disclose a mechanism by which ozone may be injected directly into the wet cleaning washing means. U.S. Pat. No. 5,763,382 to Cooper et al. discloses a cold water washing formula and method that includes ozonated water.

Another grouping of background patent are those patents that disclose a system and method for generating ozonated water. Note U.S. Pat. Nos. 5,939,030 and 6,153,151 to Moxley et al.

Notwithstanding the existence of such prior art laundry apparatus and methods, there is a need for an improved and more efficient apparatus and method for using dry cleaning machines to clean laundry that will achieve the requisite level of cleaning without having harmful effects on persons and the environment It is, therefore, to the effective resolution of the aforementioned problems and shortcomings of the prior art that the present invention is directed.

However, in view of the prior art in at the time the present invention was made, it was not obvious to those of ordinary skill in the pertinent art how the identified needs could be fulfilled.

SUMMARY OF INVENTION

The present invention provides a method for cleaning with ozone comprising the steps of establishing a predetermined ozone concentration for cleaning, providing an ozone generating means, dissolving ozone generated by the ozone generating means into a contained body of water, measuring the ozone concentration in the body of water, dissolving ozone into the contained body of water until the predetermined ozone concentration level is attained, supplying the ozonated water from the body of water to a contained wash, measuring the ozone concentration of the contained wash, and recirculating water from the wash to the body of water to substantially maintain the measured concentration of ozone in the contained wash at the predetermined ozone concentration.

The key to successfully utilizing ozone in the cleaning process is to ensure sufficient dissolved ozone in the wash water to meet the demand from the washing machine. It is not sufficient to simply generate higher levels of ozone gas, rather, it is necessary to ensure the ozone goes into solution and is maintained at a constant concentration.

It is therefore an object of the present invention to provide an improvement that overcomes the aforementioned inadequacies of the prior art and provide a significant contribution to the advancement of cleaning laundry.

Another object of this invention is to provide a method and means to use a dry cleaning machine that permits the introduction of high levels of dissolved ozone into the circulating water.

Another object of this invention is to provide a method and means to use a dry cleaning apparatus with ozone as the cleaning agent and a method that reduces or eliminates the use of hazardous solvents such as PERC.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
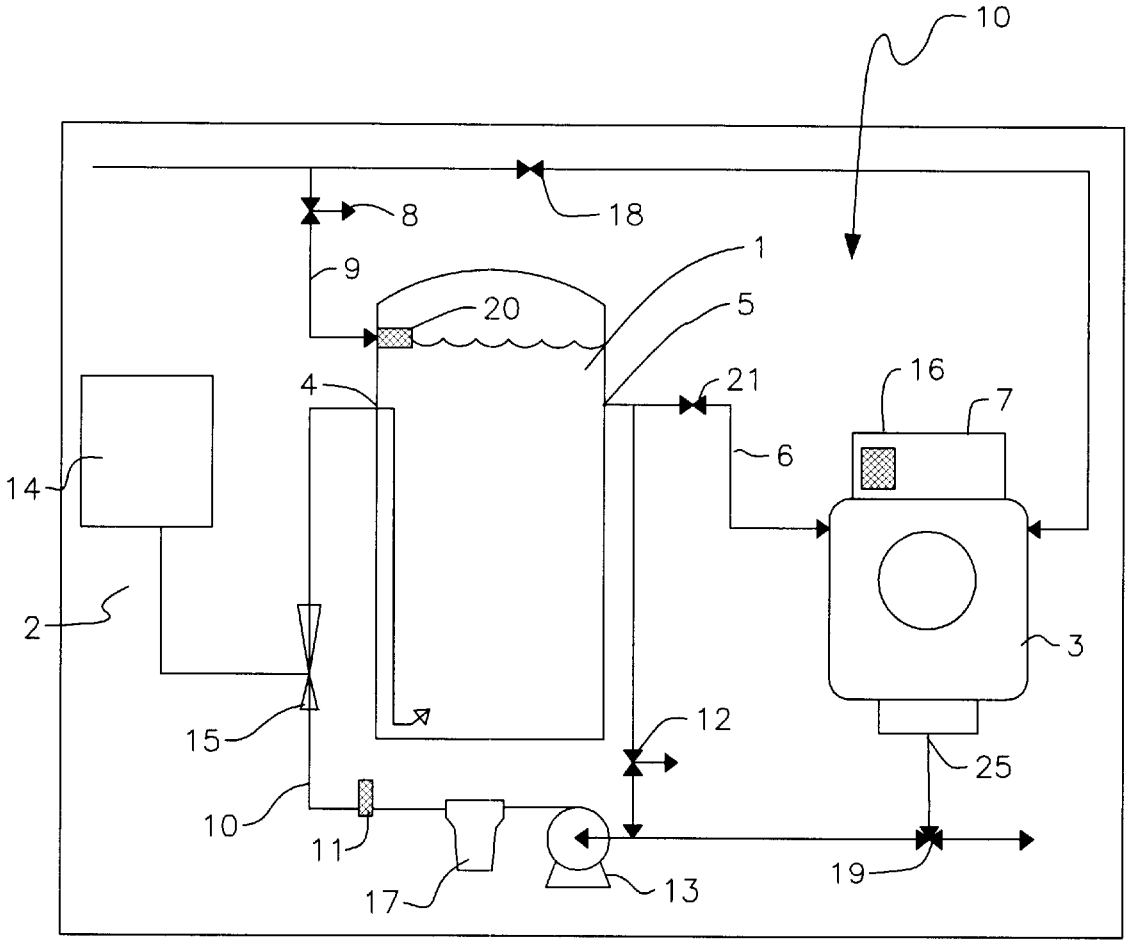
FIG. 1 is a flow diagram illustrating the laundry treatment apparatus and method of the present invention.
Figure 2:
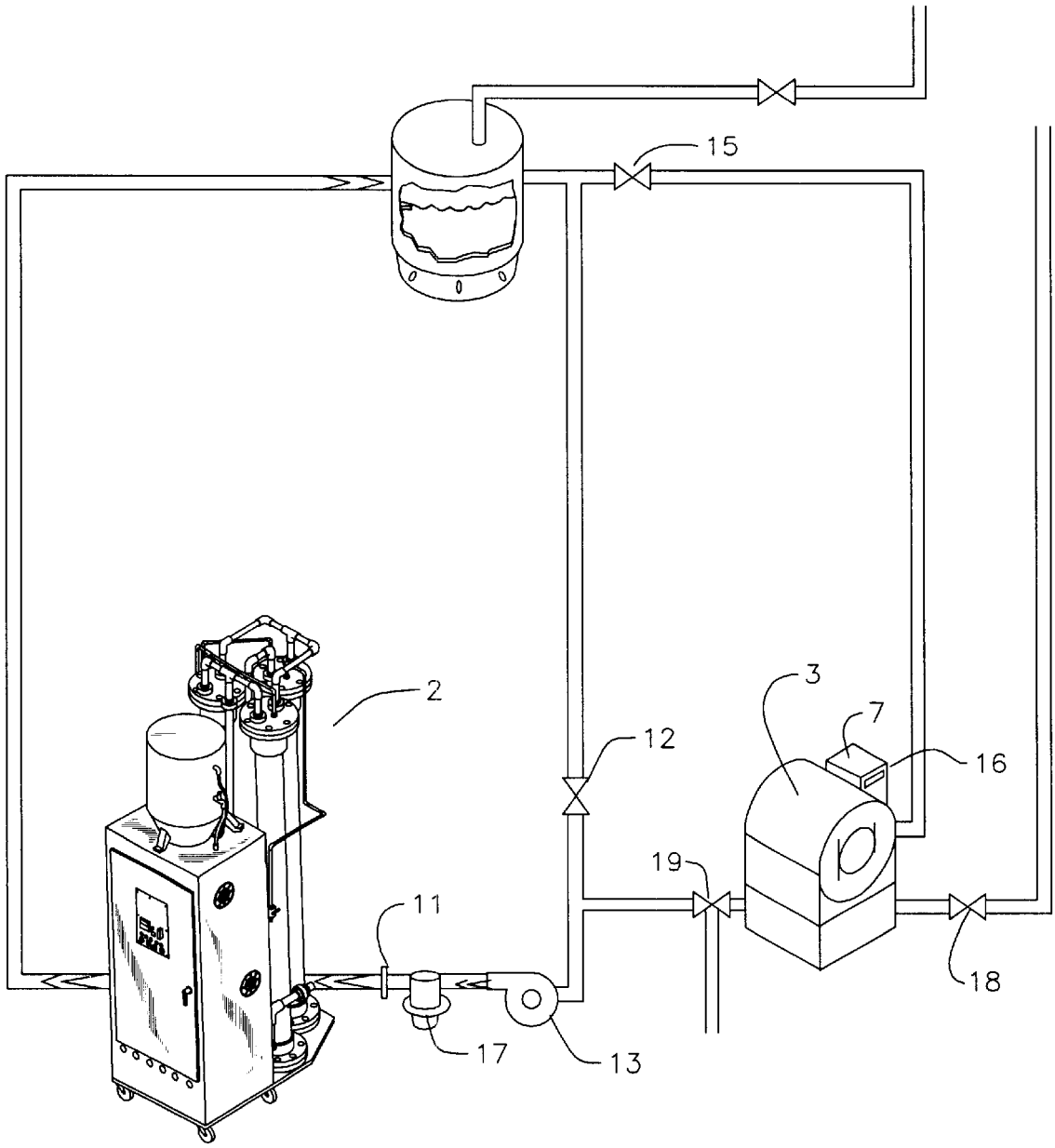
FIG. 2 is a schematic illustration of the laundry treatment apparatus and method of the present invention.

FIGS. 1 and 2 embody the principles and concepts of the present invention of a new and improved laundry cleaning treatment apparatus and method.

A feature of die present invention is the ability of the water purification means to ensure that ozone goes into solution and that the desired dissolved ozone concentration is continuously available during the cleaning process. Any commercially available ozone machine or system maybe used in association with the water purification system of the present invention, provided it can attain target purification and mass transfer requirements. However in a preferred embodiment, the ozone system utilized as the water purification means is an AJT Tech$_2$Ozone® machine as disclosed and typified in U.S. Pat. No. 5,785,864 to Teran et al. and U.S. application Ser. No. 09/123,015, the disclosures of which are incorporated herein by reference.

As shown in FIGS. 1 and 2, the apparatus of the present invention comprises an ozonated water supply tank 1, an ozone water purification system 2, and a dry cleaning washing machine 3. The tank 1 shall include at least one water inlet 4 and one water outlet 5. The dry cleaning machine 3 is in fluid communication with ozonated wash water from a supply tank 1 via a supply conduit 6.

Preferably, the apparatus and method of the present invention may be monitored and controlled via a control system that utilizes a programmable logic controller (PLC) 7, which will incorporate the use of in-line analytical instrumentation for remote access. However, it should be well understood by one skilled in the art that the control system could also be relay breakers, manual valve operation, or a computer software system.

Generally speaking, three parameters may be used in controlling the apparatus and method of the present invention. These parameters are, (1) the water level in the supply tank 1, (2) the dissolved ozone concentration of the water in the supply tank 1 and (3) the oxidation-reduction potential (ORP) of the water in the return conduit 10.

Depending on how the operator programs the PLC 7, the following steps will occur upon activation of the apparatus and method of the present invention to ensure there is adequate ozonated wash water, with the appropriate level of dissolved ozone, immediately available upon demand by the dry cleaning machine 3.

At the beginning of the cleaning method, water from a water supply is pumped through first valve 8 via make-up water supply conduit 9 to fill water supply tank 1 to a desired level. PLC 7 will detect the dissolved ozone concentration in return conduit 10 through the use of dissolved ozone monitor 11. Dissolved ozone monitor 11 should be capable of reading dissolved ozone concentrations up to at least 20 PPM. In a preferred approach, water is first continuously circulated during an initial ozonation circulation process through ozone water purification system 2 and back to ozonated water supply tank 1 via recirculation valve 12. Preferably, the present invention incorporates pump means 13 that maintains the level of water in ozonated water supply tank 1 and circulates water through ozone system 2. If the concentration of dissolved ozone is below die desired level, then water will continue circulating from tank 1 through pump means 13 and back to tank 1 via recirculation valve 12. Ozone gas from ozone generation means 14 is injected in the water through ozone supply means 15 in order to build the dissolved ozone concentration of the water. During this process, wash valve 21 of washer 3 will be closed and recirculation valve 12 will be open. This initial ozonation circulation process continues until the desired dissolved ozone concentration is reached. In the preferred embodiment, when the desired dissolved ozone concentration is reached, a green light on washer control panel 16 will come on indicating that the system is ready to start washing.

At that point, the system is ready to wash. The operator will start the washer and the system will automatically through controller 7, close recirculation valve 12 and open the wash valve 21 of the washer. Under these conditions, the water is circulated from tank 1 to washer 3 through pump 13 and ozone supply means 15 and finally back to ozonated water supply tank 1 via wash valve 21. Ozone is continuously being introduced into the water through the ozone supply means 15. In a preferred approach, this wash and ozonation circulation process goes on for a minimum of 10 minutes and after the ten minutes the wash is complete.

Prior to the water being circulated through the ozone system, a filtration means 17 removes solids from the water. In the preferred embodiment, the filter media has a pore size small enough to retain bacteria, precipitated and flocculated soils and chemicals, and lint from fabric.

In a preferred approach, an additional freshener step may be incorporated in the wash cycle to add a pleasant smell to the garments. The freshener step is a normal washer operations step where cold make-up water is supplied through the cold water valve 18 that will close when the water level inside the washer is reached. During this step, the PLC 7 will open recirculation valve 12 and allow the ozonation circulation process to continue. The PLC 7 will open three-way valve 19 to allow the water to drain to the sewer when the freshener cycle is finished.

While the water is being circulated through the wash and ozonation circulation process, the PLC 7 continually monitors the water level in the supply tank 1 through a water level sensor 20 and the dissolved ozone concentration of the water through the ORP 11. If any of the parameters falls below the desired set point, then the PLC 7 will terminate water circulation from the supply tank 1 to the washing means 3 and fill the supply tank 1 or circulate water through the ozonation circulation process.

Figure 3:
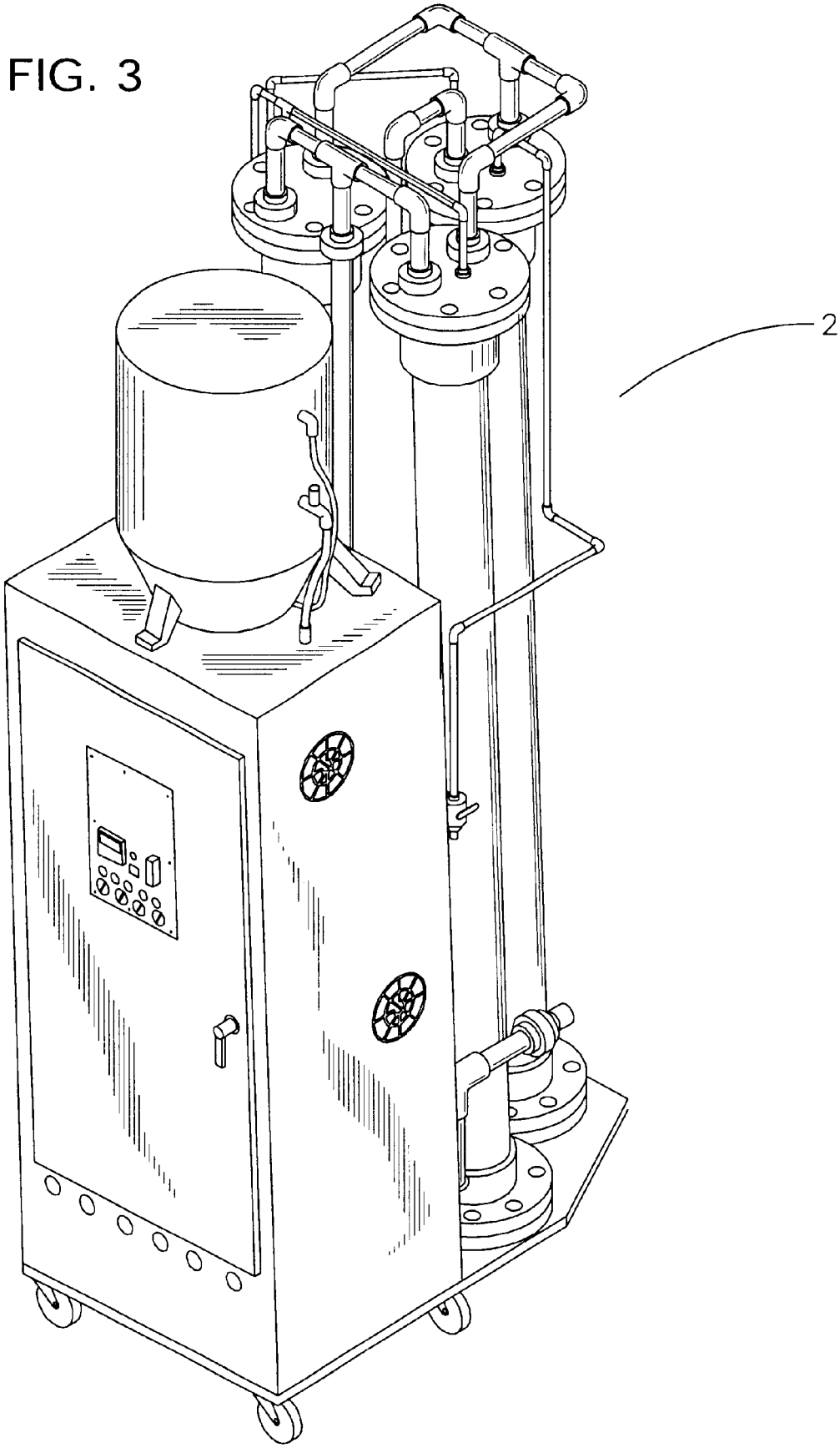
FIG. 3 is an illustration of a preferred ozone system that may be incorporated into the laundry treatment apparatus of the present invention. Similar reference characters refer to similar parts throughout the several views of the drawings.

As illustrated in FIG. 3, the ozone system, may incorporate a plurality of contact columns sized to ensure a minimum contact time within the columns, although other systems could be utilized without departing from the spirit of the present invention. Each contact column is a longitudinally extending elongate hollow enclosure having a closed top-portion, a closed bottom portion, and a gas tight interior space therein. An ozone supplier means is disposed between the water source and the plurality of contact columns whereby ozone may be introduced into the water flow. Furthermore, an ozone source is connected in fluid flow communication with the plurality of contact columns.

Another embodiment of the ozone system may use a venturi-type injection system as an alternative to the contact column shown in FIG. 3. A venturi device has a narrowing orifice that causes an increase in pressure and flow velocity of a fluid passing through the device. The increase in pressure and velocity of the fluid results in increased turbulence and thus an increased number of bubbles and reduced bubble size. This provides an optimal opportunity for transfer of ozone from the gas to liquid phases.

The ozone system of the present system incorporates a supply pump (not shown) that draws feed water from a source. The water then passes through a valve or water flow adjustment means. Any commercially available water pump may be used in the present application. The flow rate of the water may be adjusted to the desired rate by means of a water flow adjustment means.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described,

What is claimed is:

1. A method for cleaning with ozone comprising the steps of: establishing a predetermined ozone concentration for cleaning;

establishing an ozone generating means;

dissolving ozone generated by the ozone generating means into a contained body of water;

measuring the ozone concentration in the body of water;

dissolving ozone into the contained body of water until the predetermined ozone concentration level is attained;

supplying the ozonated water from the body of water to a contained wash;

measuring the ozone concentration of the contained wash; and recirculating water from the wash to the body of water to substantially maintain the measured concentration of ozone in the contained wash at the predetermined ozone concentration.

2. The method of claim 1, further comprising the step of filtering recirculated water for particulate debris.

* * * * *